US006722435B2

(12) United States Patent
DeGeare

(10) Patent No.: US 6,722,435 B2
(45) **Date of Patent: *Apr. 20, 2004**

(54) WINDOW FORMING BY FLAME CUTTING

(75) Inventor: Joseph P. DeGeare, Houston, TX (US)

(73) Assignee: Weatherford/Lamb, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/483,437

(22) Filed: Jan. 14, 2000

(65) Prior Publication Data

US 2002/0060074 A1 May 23, 2002

Related U.S. Application Data

(60) Provisional application No. 60/115,978, filed on Jan. 15, 1999.

(51) Int. Cl.[7] ..... E21B 43/1185
(52) U.S. Cl. ..... 166/297
(58) Field of Search ..... 166/55, 297, 298, 166/55.2, 63, 72, 117.5, 117.6

(56) References Cited

U.S. PATENT DOCUMENTS

| | | | | |
|---|---|---|---|---|
| 2,506,799 A | | 5/1950 | Livingston | |
| 2,535,964 A | | 12/1950 | Stanton | |
| 2,587,244 A | | 2/1952 | Sweetman | |
| 2,649,046 A | | 8/1953 | Davis | |
| 2,758,543 A | * | 8/1956 | Grandin | 175/4.6 |
| 4,298,063 A | | 11/1981 | Regalbuto et al. | |
| 4,352,397 A | | 10/1982 | Christopher | |
| 4,446,920 A | | 5/1984 | Woytek et al. | |
| 4,534,423 A | | 8/1985 | Regalbuto | 175/4.6 |
| 4,598,769 A | | 7/1986 | Robertson | 166/55 |
| 4,798,244 A | | 1/1989 | Trost | 166/250 |
| 4,799,829 A | * | 1/1989 | Kenny | 405/195 |
| 4,905,759 A | | 3/1990 | Wesson et al. | 166/55 |

(List continued on next page.)

FOREIGN PATENT DOCUMENTS

| | | | |
|---|---|---|---|
| EP | 0819827 A2 | 1/1998 | |
| EP | 0 846 838 A2 | 6/1998 | E21B/29/02 |
| GB | 2177740 A | 1/1987 | E21B/29/02 |
| GB | 2 346 633 A | 8/2000 | E21B/29/02 |
| SU | 1537793 A | 5/1987 | E21B/43/11 |
| WO | WO97/21903 | 6/1997 | |
| WO | WO 99/64715 | 12/1999 | E21B/29/06 |
| WO | WO 00/50727 | 8/2000 | E21B/7/08 |
| WO | WO 00/66876 | 11/2000 | E21B/29/00 |

OTHER PUBLICATIONS

Cole, James; SPE/IADC 52824; Pyro Technology for Cutting Drill Pipe and Bottomhole Assemblies, 1999, 6 pages.
Robertson, Michael; Radial Cutting Torch, Department of Energy Tech Brief; Dec. 1994, 3 pages.
Typical Radial Cutting Torch Assembly, MRC Oil Tools, Date unknown, 2 pages.

*Primary Examiner*—Zakiya Walker
(74) *Attorney, Agent, or Firm*—Moser, Patterson & Sheridan, L.L.P.

(57) ABSTRACT

A tool containing a solid combustible material is used to provide a pipe-cutting flame and to direct a pipe-cutting flame against a casing or tubular. The nozzles can be configured in any desired array and intensity. In the preferred embodiment, a rectangular window is burned away completely if the nozzles are sufficiently intense or the window is formed in segments if other distributions are used. The device can be anchored by a packer or anchor and can be run in the wellbore on tubing, wireline or electric line. The window can be produced in a single trip. The tool can be removed and a kick-off diverter installed adjacent the window for drilling the lateral.

15 Claims, 4 Drawing Sheets

U.S. PATENT DOCUMENTS

| | | | | | |
|---|---|---|---|---|---|
| 4,960,171 | A | * | 10/1990 | Parrott et al. | 166/55 |
| 5,135,050 | A | | 8/1992 | Tailby | 166/99 |
| 5,435,394 | A | | 7/1995 | Robertson | 166/382 |
| 5,636,692 | A | | 6/1997 | Haugen | |
| 5,690,171 | A | | 11/1997 | Winch et al. | 166/63 |
| 5,709,265 | A | | 1/1998 | Haugen et al. | |
| 5,791,417 | A | * | 8/1998 | Haugen et al. | 166/298 |
| 5,813,465 | A | | 9/1998 | Terrell et al. | 166/298 |
| 5,862,862 | A | * | 1/1999 | Terrell | 166/298 |
| 6,016,753 | A | | 1/2000 | Glenn et al. | 102/307 |
| 6,024,169 | A | | 2/2000 | Haugen | 166/298 |
| 6,035,935 | A | * | 3/2000 | Regalbuto | 166/298 |
| 6,135,206 | A | | 10/2000 | Gano et al. | 166/297 |
| 6,202,752 | B1 | | 3/2001 | Kuck et al. | 166/298 |
| 6,536,525 | B1 | | 3/2003 | Haugen et al. | 166/297 |
| 2002/0170713 | A1 | | 11/2002 | Haugen et al. | 166/298 |
| 2003/0070812 | A1 | | 4/2003 | Robertson | 166/298 |

* cited by examiner

WINDOW FORMING BY FLAME CUTTING

CROSS-REFERENCE TO RELATED APPLICATIONS

This application claims benefit of U.S. provisional patent application Ser. No. 60/115,978, filed Jan. 15, 1999, which is herein incorporated by reference.

FIELD OF THE INVENTION

The field of the invention relates to flame-cutting techniques for making windows in casing for drilling laterals in existing wellbores.

BACKGROUND OF THE INVENTION

FIG. 1*a* illustrates a traditional method of window forming wherein a starter mill 10 is directed by whipstock 12 into the wall of the casing 14. The typical shape of a window or opening 16 is shown in FIG. 1*b*. The window is narrow when initially cut and proceeds to its maximum width when the mill 10 is approximately in the position shown in FIG. 1*a* as its center is in alignment with the wall of the casing 14. The mill 10 tends to bog down at this point because there is little relative rotation when the center of the mill is in alignment with the wall of the casing 14. As a result, typically mills have been designed to have a build-up of cutting material 18 (shown in FIG. 1*c*) to prevent coring out the starter mill 10 as it bogs down in the position shown in FIG. 1*a*. Eventually, the starter mill 10 continues to cut and the remainder of the window (shown in FIG. 1*b* as the lower half) begins to get progressively narrower until the starter mill 10 exits the window completely.

The traditional technique of using one or more mills, even if done in a one-trip technique involving orientation tools coupled with an anchor or packer, is still fairly time-consuming. Accordingly, one of the objectives of the present invention is to dramatically decrease the time required for formation of the window. Additionally, another objective of the invention is to be able to cut any desired window shape in a minimum amount of time, with the result that minimum debris or residue is left after employing the technique. Another objective is to eliminate the typical window profile illustrated in FIG. 1*b* so that shorter kickoff diverters can be used when drilling the lateral through the window that is produced.

In the past, casing to be cut in two in a wellbore has been cut using techniques involving ignited combustible materials which are directed to a radial nozzle or nozzles to cut cleanly through the casing or tubular. These types of devices using a cutting flame radially to cut through a pipe are illustrated in U.S. Pat. Nos. 4,598,769 and 5,435,394. These devices are limited-purpose tools for cutting radially through a casing.

Explosive techniques for making a window in casing, using a shaped charge attached to a starter mill which is, in turn, attached to a whipstock, is illustrated in U.S. Pat. No. 5,636,692.

Another objective of the present invention is to use flame-cutting techniques to produce a window of desired shape rapidly to facilitate further downhole operations.

These aspects of the method will be more readily understood by those skilled in the art from a review of the details of the preferred embodiment described below.

SUMMARY OF THE INVENTION

A tool containing a solid combustible material is used to provide a pipe-cutting flame and to direct a pipe-cutting flame against a casing or tubular. The nozzles can be configured in any desired array and intensity. In the preferred embodiment, a rectangular window is burned away completely if the nozzles are sufficiently intense or the window is formed in segments if other distributions are used. The device can be anchored by a packer or anchor and can be run in the wellbore on tubing, wireline or electric line. The window can be produced in a single trip. The tool can be removed and a kick-off diverter installed adjacent the window for drilling the lateral.

DETAILED DESCRIPTION OF THE PREFERRED EMBODIMENT

Figure 3:
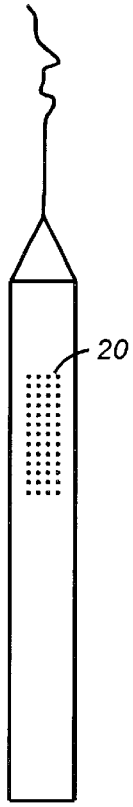
FIG. 3 illustrates the flame jet distribution in a rectangular high-intensity pattern for burning a complete window in a casing or tubular.
Figure 9:
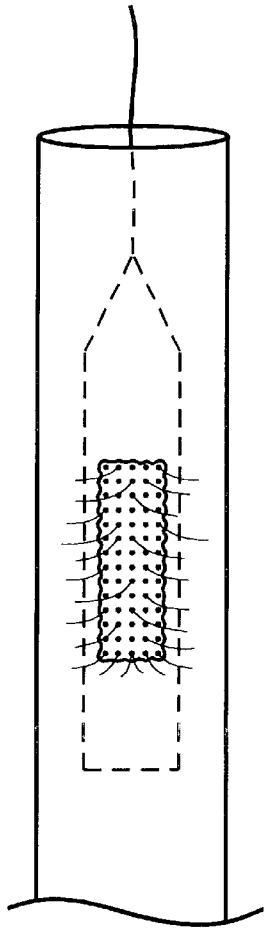
FIG. 9 is the tool of FIG. 8 shown as fired.

The method of the present invention is illustrated in the attached figures. The flame-cutting apparatus, first described in U.S. Pat. No. 4,598,769, is reconfigured to have a plurality of nozzles arranged in a variety of patterns. FIG. 3 illustrates a generally rectangular orientation of nozzles 20, placed in very close quarters so that when actuated, as shown in FIG. 9, a rectangular opening 22, shown in FIG. 10, can be produced without any casing segments falling into the wellbore. In essence, the intense heat delivered by the nozzles 20 in a closely confined array, such as shown in FIG. 3, essentially at 6000° F. or higher, results in the formation of the window 22 without any significant debris in the wellbore.

Figure 4:
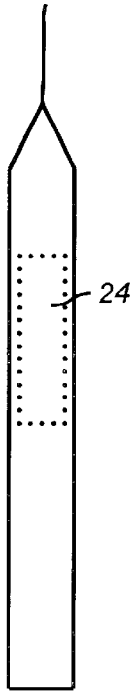
FIG. 4 shows an alternative to FIG. 3 where a rectangular window is burned at its periphery, leaving a single residual piece to come out of the casing wall.
Figure 5:
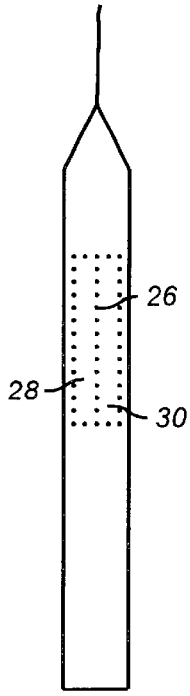
FIG. 5 is an alternative to FIG. 4, indicating two pieces falling from the casing or tubular when making a rectangular window.
Figure 6:
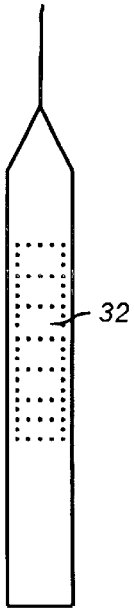
FIG. 6 is an alternative to FIG. 5, making an overall rectangular window by burning away smaller rectangularly shaped pieces.
Figure 7:
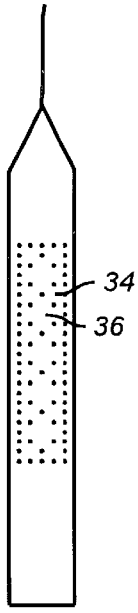
FIG. 7 is an alternative to FIG. 6, illustrating the technique for making a rectangular window, leaving triangular and diamond-shaped pieces.

Referring to FIG. 4, a rectangular window is formed by cutting the periphery of the window, leaving a piece of the casing 24 as debris in the wellbore. FIG. 5 is similar to FIG. 4 except that an additional longitudinal row 26 has been added so that the debris comprises of two pieces 28 and 30. FIGS. 6 and 7 illustrate alternative nozzle patterns which result, respectively, in a series of rectangular pieces of debris 32 when making a rectangular window, or, as shown in FIG. 7, a combination of triangular and parallelogram shapes 34 and 36, respectively.

Figure 8:
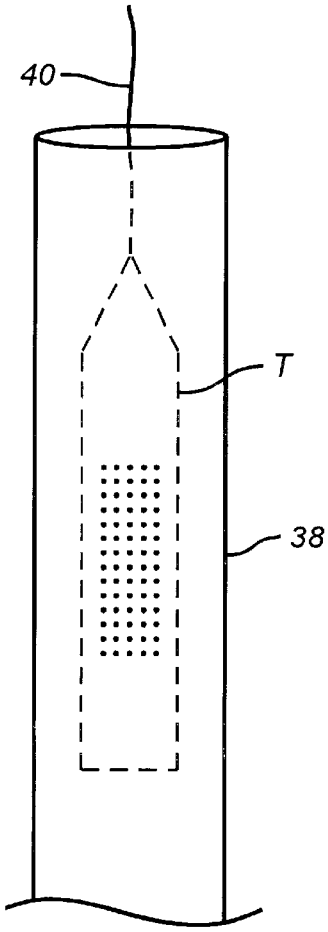
FIG. 8 illustrates the tool in casing having a rectangular pattern with an intensity sufficient to burn away a rectangular opening in the casing.
Figure 10:
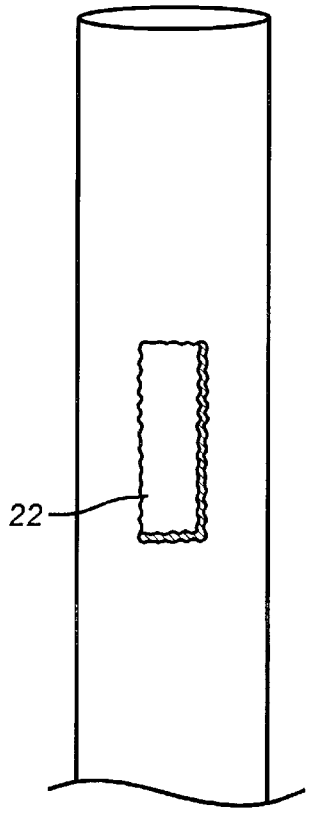
FIG. 10 shows the window made from firing as reflected in FIG. 9.

FIG. 8 illustrates schematically running the tool T into the casing 38. The support 40 is shown schematically and can be an electric line, wireline, or coiled tubing, and can also include known orientation equipment to properly position the tool T before it is fired. FIG. 9 illustrates the tool with a layout of nozzles 20 akin to that shown in FIG. 3 being fired, while FIG. 10 illustrates the window 22 after the tool has been removed.

Figure 1A:
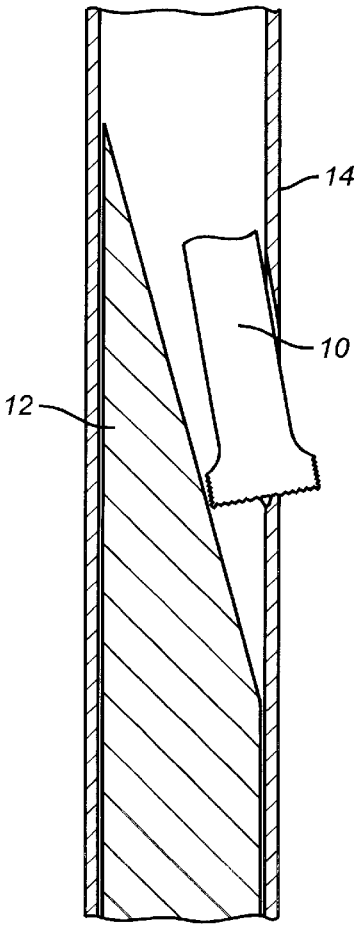
(PRIOR ART) FIG. 1a
FIG. 1*a* is a sectional elevational view of the prior art technique for milling a window using a starter mill and a whipstock.
Figure 1B:
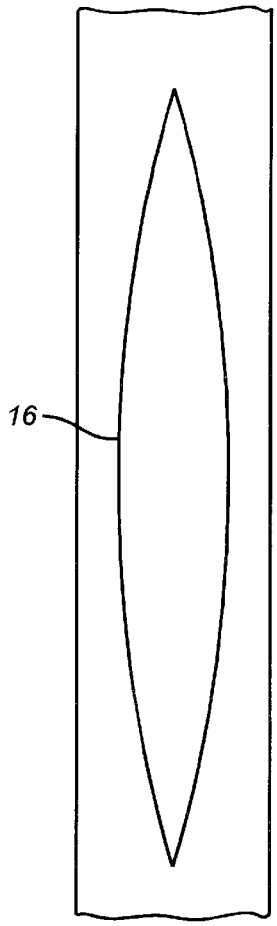
(PRIOR ART) FIG. 1b
FIG. 1*b* is the resulting window made by using the technique shown in FIG. 1*a*.
Figure 1C:
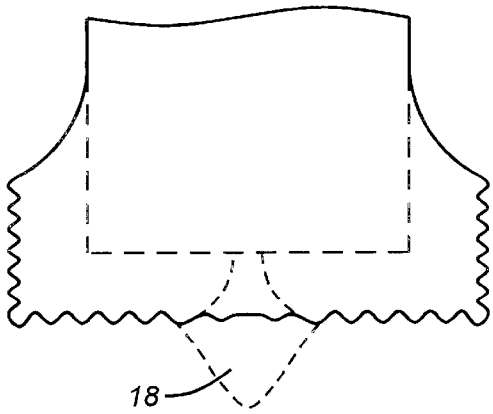
FIG. 1*c* is the view of a typical starter mill used for making windows in the prior art.
Figure 2:
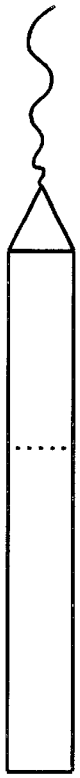
(PRIOR ART) FIG. 2
FIG. 2 illustrates a radial flame cut produced by a prior art pipe-cutting apparatus illustrated in U.S. Pat. No. 4,598,769.
Figures 11, 12, 13, 14:
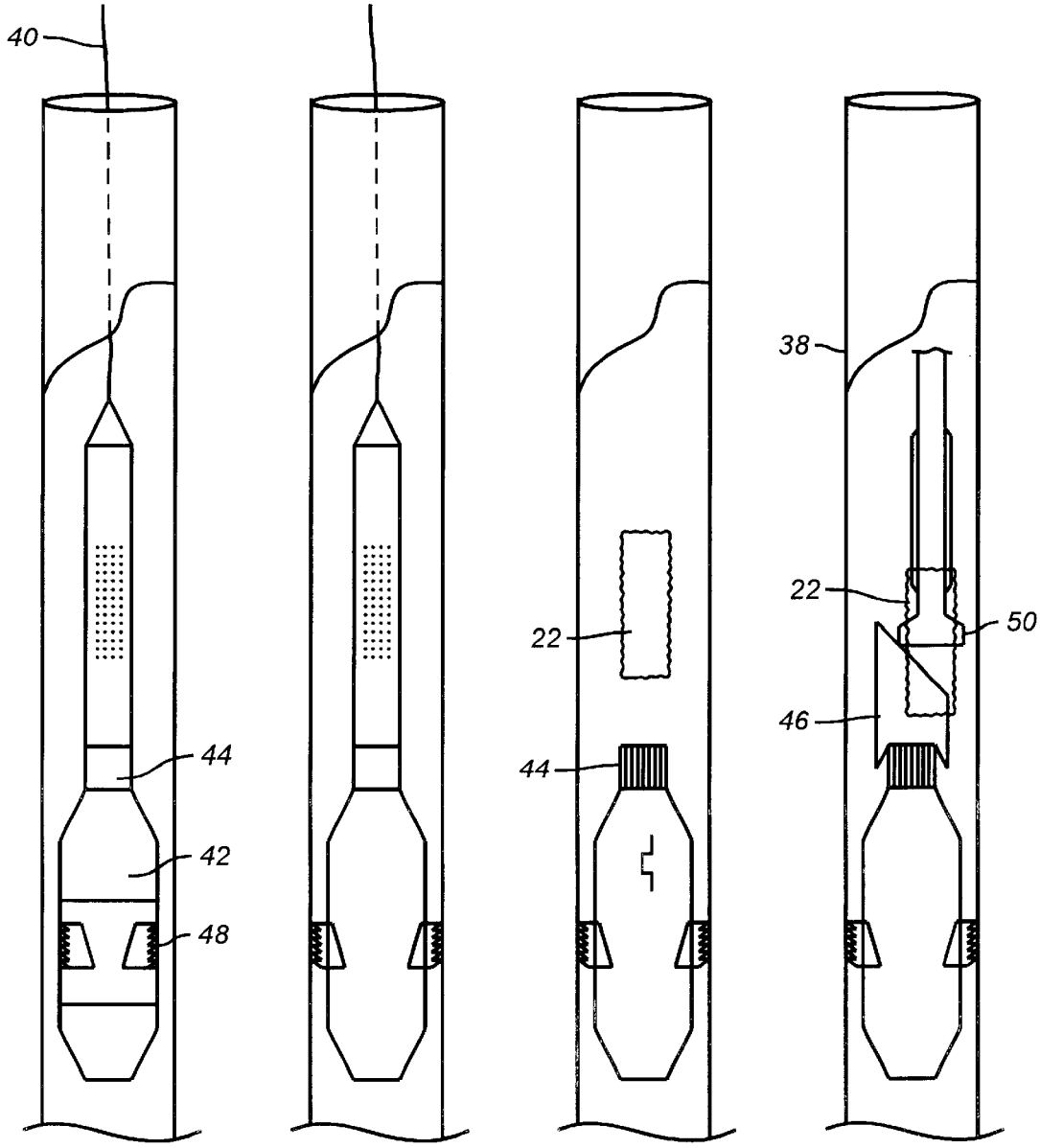
FIG. 11 illustrates the use of an anchor or packer or bridge plug for support of the tool in the run-in position.
FIG. 12 shows the fully supported position for the tool prior to firing.
FIG. 13 shows the formation of a rectangular window and the subsequent removal of the tool, exposing an anchor for a kick-off diverter.
FIG. 14 shows the installation of the kick-off diverter and the drillstring for drilling the lateral through the window.

FIG. 11 is a more detailed view of the method of the present invention. Here, a packer or bridge plug 42 supports an anchor 44, which eventually accepts a short diverter 46 as shown in FIG. 14. The packer or bridge plug 42 has slips 48 which are retracted in FIG. 11 and set in FIG. 12. The orientation is determined prior to setting the slips 48, using a known measurement-while-drilling (MWD) tool, which is part of the assembly of support 40. Thereafter, as shown in FIG. 13, the tool T is fired to make the window 22 and is subsequently released from the anchor 44. The diverter 46 is configured so that when it is secured to the anchor 44, it points into window 22. In using the method of the present invention, the shape of the window can be more certainly relied upon as being rectangular, as opposed to techniques in the prior art which resulted in a more elliptical shape, as shown in FIG. 1*b*. Thus, the diverter 46 can be of fairly short length. Another advantage is that with the window 22 being produced essentially rectangular, the mill 50 does not bog down when it is about half-way through the window, as in the prior art illustrated in FIG. 1*a*. The reason for this is that there is no longer any metal to mill through at a time when there is little relative rotation between the bit 50 and the casing 38.

Since the opening 22 is reliably rectangular, the placement of the diverter 46 is not as critical as in the prior art, where the shape of the window was more elliptical, as shown in FIG. 1*b*. With the window 16 having the shape shown in FIG. 1*b*, it was more important to position the diverter to get the bit kicked off toward the widest spot in the window. With a reliably made rectangular opening, vertical placement of the diverter 46 is not critical.

The foregoing disclosure and description of the invention are illustrative and explanatory thereof, and various changes in the size, shape and materials, as well as in the details of the illustrated construction, may be made without departing from the spirit of the invention.

What is claimed is:

1. A method for providing an access through a wall of a wellbore tubular, comprising:

providing a body having an array of nozzles and a combustible material, wherein the nozzles are arranged in close quarters so as not to leave tubular debris in-the wellbore adjacent the nozzles;

positioning the body in the wellbore tubular;

igniting the combustible material and allowing products of the combustion to flow through the array of nozzles thereby forming the access; and locating a diverter member proximate the previously-formed access for diverting a tool through the access.

2. The method of claim 1, the access comprising a generally rectangularly shaped window in the tubular.

3. The method of claim 2, further comprising running said body into the wellbore tubular on a tool selected from the group consisting of electric line, wireline, and coiled tubing.

4. The method of claim 1, further comprising forming said window in a single trip.

5. The method of claim 4, further comprising running in a support and an orientation device for said nozzles with said body.

6. A method for forming a lateral wellbore through a wall of a wellbore tubular, comprising:

providing a body having an array of nozzles and a combustible material;

arranging the nozzles to define a substantially rectangular shaped window;

positioning the body in the wellbore tubular;

igniting the combustible material and allowing products of the combustion to flow through the array of nozzles thereby forming a window;

locating a diverter member proximate the window after the window is formed; and forming a lateral wellbore through the previously-formed window.

7. The method of claim 6, further comprising running said body into the wellbore tubular on a tool selected from the group consisting of electric line, wireline, and coiled tubing.

8. The method of claim 6, further comprising forming said window in a single trip.

9. The method of claim 8, further comprising running in a support and an orientation device for said nozzles with said body.

10. The method of claim 6, wherein the diverter member is set after the access is formed.

11. The method of claim 10, further comprising forming a lateral wellbore through the access.

12. The method of claim 6, further comprising forming a lateral wellbore through the access.

13. A method for forming a lateral wellbore through a wall of a wellbore tubular, comprising the steps of:

providing a body having a nozzle portion and a combustible material wherein the nozzle portion is arranged to dispense products of combustion in a predetermined pattern;

positioning the body in the wellbore tubular;

igniting the combustible material and dispensing the products of combustion through the nozzle portion thereby forming an opening through a wall in the wellbore tubular;

diverting a tool through the formed opening; and forming a lateral wellbore with the tool.

14. The method of claim 13, further comprising the step of: locating a diverter adjacent the opening.

15. The method of claim 13, wherein the opening is substantially rectangular.

* * * * *

UNITED STATES PATENT AND TRADEMARK OFFICE

CERTIFICATE OF CORRECTION

PATENT NO. : 6,722,435 B2
APPLICATION NO. : 09/483437
DATED : April 20, 2004
INVENTOR(S) : Joseph P. DeGeare It is certified that error appears in the above-identified patent and that said Letters Patent is hereby corrected as shown below:

In the Claims section:

Column 3, Claim 1, lines 61 and 62, after "debris" and before "adjacent", please delete "[in-the wellbore]".

Signed and Sealed this

Twenty-eighth Day of November, 2006

JON W. DUDAS
*Director of the United States Patent and Trademark Office*